United States Patent [19]

Griffith

[11] Patent Number: 4,706,716

[45] Date of Patent: Nov. 17, 1987

[54] HEALD FRAME FOR A WEAVING LOOM

[75] Inventor: John D. Griffith, Boldon, England

[73] Assignee: Sulzer Brothers Limited, Winterthur, Switzerland

[21] Appl. No.: 848,921

[22] Filed: Apr. 7, 1986

Related U.S. Application Data

[62] Division of Ser. No. 618,046, Jun. 7, 1984, abandoned.

[30] Foreign Application Priority Data

Jun. 16, 1983 [GB] United Kingdom ..... 8316401

[51] Int. Cl.[4] ..... D03C 9/06

[52] U.S. Cl. ..... 139/91

[58] Field of Search ..... 139/91, 92, 82, 83, 139/84, 87, 88

[56] References Cited

U.S. PATENT DOCUMENTS

| | | | |
|---|---|---|---|
| 2,344,212 | 3/1944 | Osteen | 139/82 |
| 2,700,399 | 1/1955 | Pfarvwaller | 139/92 |
| 2,722,949 | 11/1955 | Kaufmann | 139/92 |
| 3,693,667 | 9/1972 | Arnold | 139/91 |
| 3,796,235 | 3/1974 | Muller | 139/91 |

FOREIGN PATENT DOCUMENTS 281465 1/1915 Fed. Rep. of Germany ..... 139/82

*Primary Examiner*—Henry S. Jaudon

*Attorney, Agent, or Firm*—Dann, Dorfman, Herrell & Skillman

[57] ABSTRACT

A heald frame for a weaving loom comprising an upper cross-member and a lower cross-member adapted to support healds directly therebetween. The upper and lower cross-members are joined together by spaced end members and a plurality of connection members spaced along the length of the cross-members between the end members and attached to the cross-members to restrain relative movement between the cross-members and retain a constant spaced relationship between the cross-members along their length. The connection members have portions of a narrow width extending between the upper and lower cross-members so that, during weaving, warp yarns pass the connection members without interference. First and second connection members are disposed, respectively, at opposite ends of each connecting member for causing reciprocation of the frame.

9 Claims, 3 Drawing Figures

HEALD FRAME FOR A WEAVING LOOM

The present application is a divisional application of Ser. No. 618,046 filed June 7, 1984, now abandoned.

The present invention relates to a heald frame for a weaving loom, in particular a weaving loom wherein weft insertion is achieved using a pressurized fluid, conveniently compressed air.

According to one aspect of the present invention there is provided a heald frame for a weaving loom comprising an upper cross-member and a lower cross-member adapted to support healds directly therebetween, said upper and lower cross-members being joined together by spaced end members, a plurality of connection members spaced along the length of the cross-members between the end members and attached to the cross-members to restrain relative movement between the cross-members and retain a constant spaced relationship between the cross-members along their length, said connection members having portions of a narrow width extending between the upper and lower cross-members so that, during weaving, warp yarns pass the connection members without interference, and first and second connection means disposed, respectively, at opposite ends of each connecting member for connection to means for causing reciprocation of the frame.

According to another aspect of the present invention there is provided a weaving loom including a plurality of heald frames, each heald frame comprising an upper cross-member and a lower cross-member, the upper and lower cross-members being connected together by spaced end members, a plurality of healds supported directly between the cross members, a plurality of connection members spaced along the length of the cross-members intermediate the end members and attached to both cross-members so as to have portions extending therebetween to restrain relative movement between the cross-members and thereby retain a constant spaced relationship between the cross-members along their length, the portions of the connection members extending between the upper and lower cross-members being of a narrow width to enable warp yarns to pass through the heald frame without interference, first and second connection means disposed, respectively, at opposite ends of each connecting member, a first motive means for moving the frame in one direction, the first motive means for moving the frame in one direction, the first motive means being connected to each of said first connection means by a first suspension means, and a second motive means for moving the frame in the opposite direction, the second motive means being connected to each of said second connection means by a second suspension means.

Reference is now made to the accompanying drawings, in which.

Figure 2:
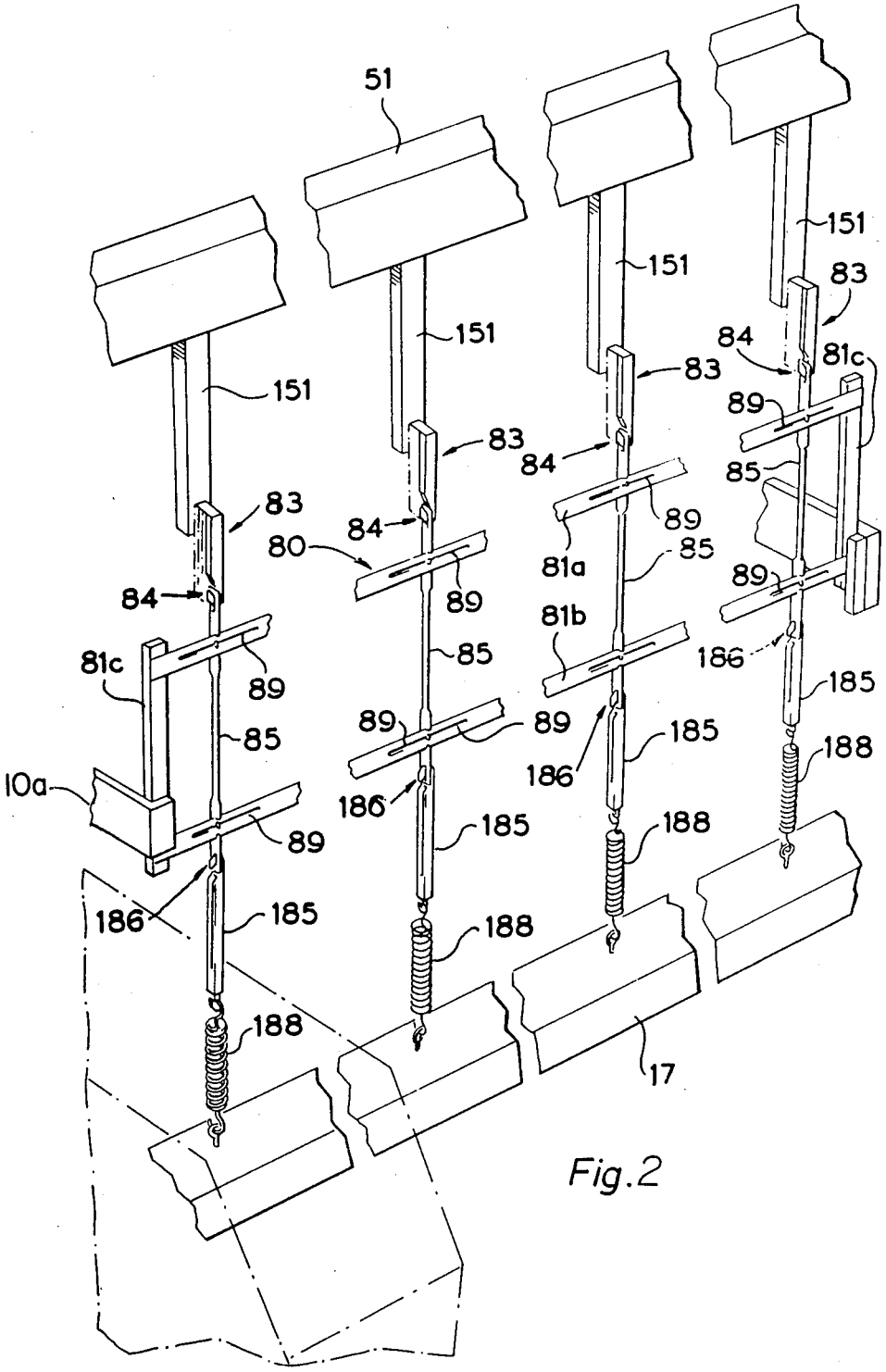
FIG. 2 is a part perspective view of a heald frame according to the present invention.

The loom 10 has a main frame which includes a pair of end walls 14 which are spaced apart and connected to one another by an upper cross-member 51 and a lower cross-member 17 (FIG. 2). The end walls 14 are preferably formed from steel plate.

The end walls 14 have rearwardly extending portions 14*a* which serve to rotatably support a beam 18 on which is wound the warp threads 20.

Figure 1:
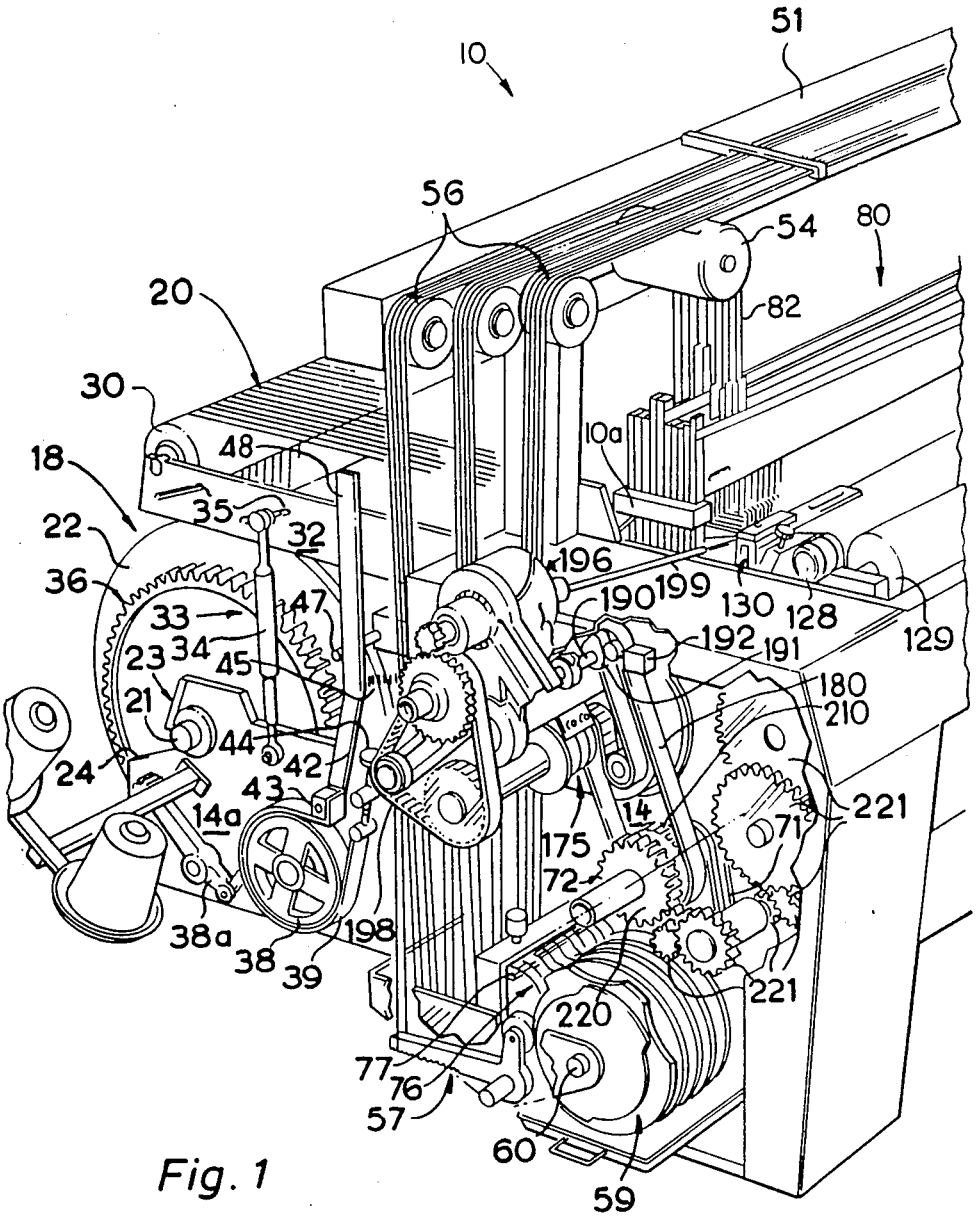
FIG. 1 shows a partly broken away perspective view of a part of a loom according to the present invention as viewed from the front and one end of the loom.

The warp threads 20 pass through a plurality of heald frames 80 shown schematically in FIG. 1. The heald frames 80 are each supported from an overhead frame 51 by means of cables 82 which extend via rollers 54 and 55 and a series of rollers 56 to a series of cam followers 57 which are operated by a series of cams 59 mounted on a cam shaft 60. The rollers 56 are laterally offset from one another to each co-operate with the cables extending from successive groups of cam followers. The cam shaft 60 is driven from a stub shaft via a chain 71. The stub shaft forms part of a clutch assembly 72.

Each heald frame 80 is biased downwardly by means of coiled springs 188 attached at one end to the heald frame and at the other end to the lower cross-member 17. The cam follower for each heald frame is thereby maintained in contact with a respective cam. Wicks 76 are provided which contact the cams to lubricate them with oil from an oil bath 77.

Figure 3:
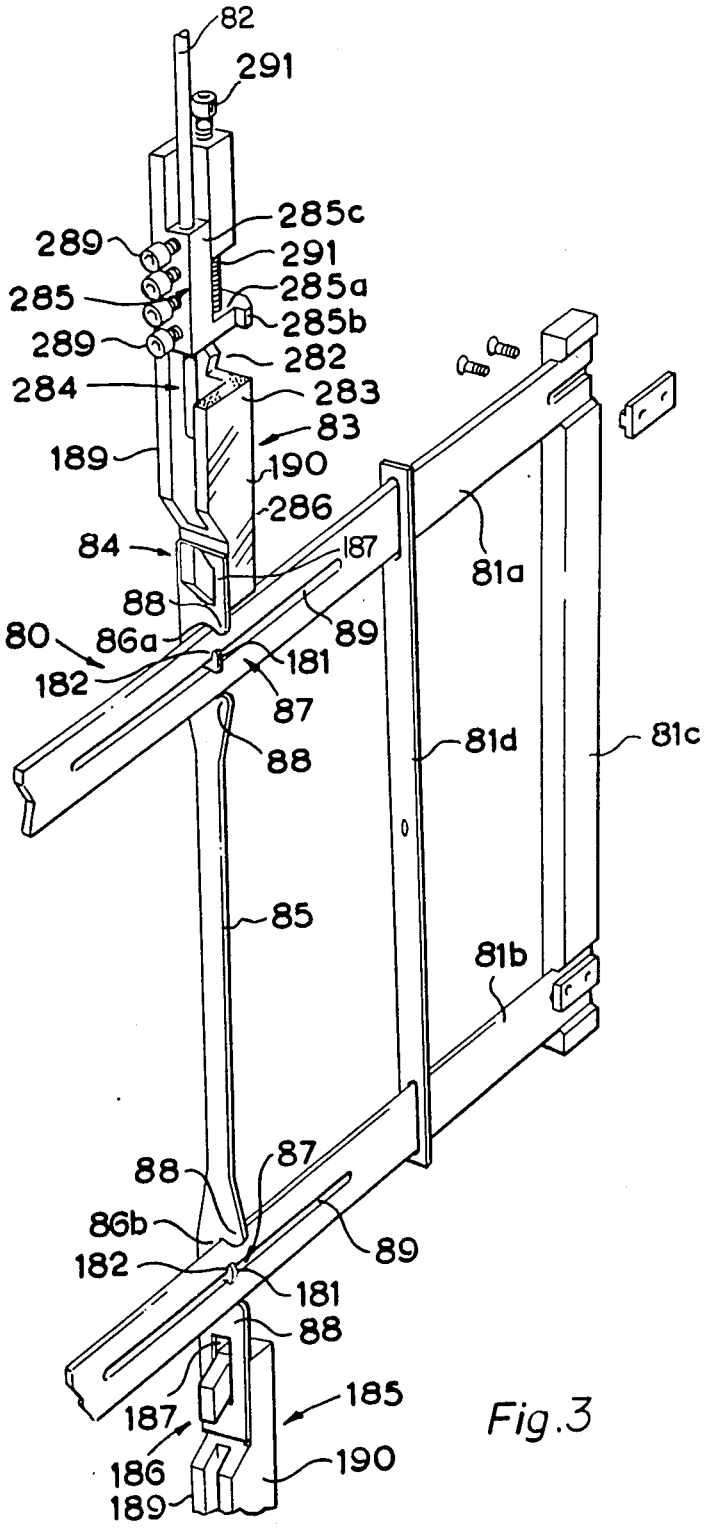
FIG. 3 is a more detailed part perspective view of the heald frame shown in FIG. 2.

The heald frame 80 of the present invention is more clearly illustrated in FIGS. 2 and 3. The heald frame 80 is designed so as to be lighter in construction than conventional heald frames thereby enabling higher speeds of weaving to be achieved.

The frame 80 includes upper and lower cross-members 81*a*, 81*b* respectively which extend across the width of the loom and are secured to one another at their ends by end members 81*c*. In the usual manner, a plurality of healds 81*d* (only one of which is shown in FIG. 3) are connected to the cross-members 81*a*, 81*b*. Each cross-member 81*a*, 81*b* is preferably formed from a thin metal strip.

The frame 80 is suspended from cables 82 which are located at spaced intervals across the width of the loom. Each cable is connected to an upper suspension member 83 which at its lower end has a hook formation 84. A connection member 85 is suspended from each hook formation 84 by means of an aperture 187 formed in the upper portion of said member and serves as a connection between the heald frame 80 and suspension member 83. Each connection member 85 extends between cross-members 81*a*, 81*b* to connect them together and retain them in spaced relationship. Each connection member 85 has upper and lower recesses 86*a*, 86*b* which respectively house the upper and lower cross-members 81*a*, 81*b*. Each recess 86*a*, 86*b*, has a mouth portion 87 which in length is less than the width of cross-members 81*a*, 81*b* so as to define a shoulder 88 which prevents member 81*a* or 81*b* moving out of a respective recess in which it is housed.

In order to enable a cross-member 81*a*, 81*b* to be inserted into a respective recess 86*a*, 86*b* a slot 89 is provided which enables the side edges of the cross-member 81*a* or 81*b* to be deflected inwardly so that they may pass through the mouth portion 87. In order to positively locate connection members 85 at predetermined intervals along the length of members 81*a*, 81*b*, location projections 181 are provided which project from the base of each recess 86*a*, 86*b* and which are received in a transverse slot 182 formed in a respective cross-member 81*a* or 81*b*.

As seen in the drawings, connection members 85 are also formed from a strip material, preferably a metal strip, and are arranged so that their flat sides are located substantially perpendicularly to the flat sides of cross-members 81*a*, 81*b*. This affords two advantages, viz. (a) the connection members 85 add rigidity to frame 80 by rigidly holding cross-members 81*a*, 81*b* at a predetermined spacing and by restraining laterial bending and (b) the connection members 85 present their narrow edges to the warp sheet and thereby do not interfere with the warp yarns, i.e. the narrow width of the connection members 85 enables warp yarns to pass either side without excessive deflection.

A lower suspension member 185 is provided which has an upper hook formation 186 located in an aperture 187 formed in the lower portion of a connection member 85. Each suspension member 185 is connected to the lower cross-member 17 of the loom via a spring 188 which serve to bias the frame 80 downwardly.

Upper and lower suspension members 83 and 185 have substantially the same width between their respective transverse sides 189, 190, which sides are flat and serve to permit sliding abutment between adjacent suspension members associated with neighbouring heald frames 80. Conveniently, the overhead frame 51 is provided with a row of depending arms 151 which serve as flat abutment surfaces against which the upper suspension members 83 associated with the heald frame 80 may slidingly abut nearest to overhead frame 51. This arrangement tends to further restrain lateral bending of frames 80.

Each upper suspension member 83 preferably comprises a body 283 having a longitudinally extending slot 284 in which part of a cable clamp 285 is housed. The body 283 also includes a slot 282 which communicates with slot 284 and opens out at a side 286. The clamp 285 has a portion 285*a* which extends through slot 282 and has a pair of shoulders 285*b* (only one of which is visible) which slidingly abut against side 286. The upper portion 285*c* of clamp 285 slidingly abuts the base of slot 284. The clamp member 285 includes a bore for receiving the cable 82 to which is to be attached and is provided with several clamping screws 289 for engaging the cable. An adjusting screw 291 is threadingly received in the upper portion of the body 283 and projects into slot 282 to engage the portion 285*a* of the clamp member. Accordingly, by rotating screw 291 the clamp member 285 may be moved along slot 284 so as to provide accurate height adjustment of the suspension member 83. Conveniently, body 283 and the corresponding body of suspension member 185 are plastic mouldings.

I claim:

1. A heald frame for a weaving loom comprising an upper cross-member and a lower cross-member adapted to support healds directly therebetween, said upper and lower cross-members being joined together by spaced end members, a plurality of connection members spaced along the length of the cross-members between the end members and attached to the cross-members to restrain relative movement between the cross-members and retain a constant spaced relationship between the cross-members along their length, said connection members having portions of a narrow width extending between the upper and lower cross-members so that, during weaving, warp yarns pass the connection members without interference, and first and second connection means disposed, respectively, at opposite ends of each connecting member for connection to means for causing reciprocation of the frame.

2. A heald frame according to claim 1, wherein the cross-members are both in the form of a thin strip and are arranged with their flat sides disposed perpendicularly to the warp yarns and each of the connection members is in the form of thin strip, the connection members being located so that their flat sides are disposed perpendicularly to the flat sides of the cross-members.

3. A heald frame according to claim 1, wherein each connection member is provided with a first recess which receives and retains the upper cross-member and with a second recess which receives and retains the lower cross-member, each recess having a mouth of a length which is less than the width of the cross-member received in the recess, each cross-member being provided with a longitudinally extending slot to enable spaced edges of the cross-member to be deflected inwardly to permit insertion of the cross-member into the recess.

4. A heald frame according to claim 3, wherein each connection member includes a projection within each recess for cooperation with the cross-member received in the recess to restrain movement of the connection member longitudinally along the cross-member.

5. A heald frame according to claim 1, further including a first motive means for moving the frame in one direction, the first motive means being connected to said first connection means by a first suspension member, and a second motive means for moving the frame in the opposite direction, the second motive means being connected to said second connection means by a second suspension member.

6. A heald frame according to claim 5, wherein the first motive means includes a cable attached to the first suspension member and said first suspension member includes a body having a cable clamp slidably received therein.

7. A weaving loom including a plurality of heald frames, each heald frame comprising an upper cross-member and a lower cross-member, the upper and lower cross-members being connected together by spaced end members, a plurality of healds supported directly between the cross-members, a plurality of connection members spaced along the length of the cross-members intermediate the end members and attached to both cross-members so as to have portions extending therebetween to restain relative movement between the cross-members and thereby retain a constant spaced relationship between the cross-members along their length, the portions of the connection members extending between the upper and lower cross-members being of a narrow width to enable warp yarns to pass through the heald frame without interference, first and second connection means disposed, respectively, at opposite ends of each connecting member, a first motive means for moving the frame in one direction, the first motive means being connected to each of said first connection means by a first suspension means, and a second motive means for moving the frame in the opposite direction, the second motive means being connected to each of said second connection means by a second suspension means.

8. A weaving loom according to claim 7, wherein the first and second suspension means each comprise plural individual suspension members connected to the first and second connection means of the connection members, the suspension members associated with neighbouring heald frames being arranged in groups, the suspension members of each group being in sliding abutment with one another and with a portion of the loom so as to restrain lateral direction of each heald frame in the warp direction during frame reciprocation.

9. A weaving loom according to claim 8, wherein the first motive means includes a series of cables each of which is attached to a respective first suspension member, each first suspension member including a body having a cable clamp slidably received therein.

* * * * *

UNITED STATES PATENT AND TRADEMARK OFFICE

CERTIFICATE OF CORRECTION

PATENT NO. : 4,706,716

DATED : November 17, 1987

INVENTOR(S) : John D. Griffith

It is certified that error appears in the above-identified patent and that said Letters Patent is hereby corrected as shown below:

Column 5, line 1, "direction" should be --deflection--.

Signed and Sealed this

Nineteenth Day of April, 1988

*Attest:*

DONALD J. QUIGG

*Attesting Officer*

*Commissioner of Patents and Trademarks*